US007663048B2

(12) United States Patent
Kaburagi et al.

(10) Patent No.: US 7,663,048 B2
(45) Date of Patent: Feb. 16, 2010

(54) CONTENT DISTRIBUTING SERVER, CONTENT DISTRIBUTING METHOD, AND CONTENT DISTRIBUTING PROGRAM

(75) Inventors: Toshiaki Kaburagi, Meguro-ku (JP); Takuya Takahashi, Shizuoka-Ken (JP)

(73) Assignee: Yamaha Corporation, Shizuoka-Ken (JP)

( * ) Notice: Subject to any disclaimer, the term of this patent is extended or adjusted under 35 U.S.C. 154(b) by 674 days.

(21) Appl. No.: 11/433,899

(22) Filed: May 12, 2006

(65) Prior Publication Data

US 2006/0272484 A1 Dec. 7, 2006

(30) Foreign Application Priority Data

May 13, 2005 (JP) ..... 2005-141533

(51) Int. Cl.
*G04B 13/00* (2006.01)
*G10H 7/00* (2006.01)

(52) U.S. Cl. ..... 84/609; 84/602; 84/610; 84/649; 84/650

(58) Field of Classification Search ..... None
See application file for complete search history.

(56) References Cited

U.S. PATENT DOCUMENTS

2007/0074618 A1* 4/2007 Vergo ..... 84/612
2007/0074619 A1* 4/2007 Vergo ..... 84/612

FOREIGN PATENT DOCUMENTS

| | | |
|---|---|---|
| JP | 2004-007407 | 1/2004 |
| KR | 1020050088838 A | 9/2005 |
| TW | 479426 | 3/2002 |
| WO | 01/50225 A2 | 7/2001 |
| WO | 2005/004434 A1 | 1/2005 |

* cited by examiner

*Primary Examiner*—Marlon T Fletcher
(74) *Attorney, Agent, or Firm*—Harness, Dickey & Pierce, PLC

(57) ABSTRACT

A content distributing server capable of reproducing desired display contents in conformity with reproduction of a desired musical composition. In response to a request from a terminal device, one of musical composition contents stored in a musical composition database is identified, and one of template contents stored in a template database is identified. A reproduction time length of the identified template content is adjusted according to a reproduction time length of the identified musical composition content. The adjusted template content is added to the musical composition content to generate a synthesized content, which is distributed to the terminal device.

18 Claims, 11 Drawing Sheets

| KEYWORD | TEMPLATE FILE |
|---|---|
| BEACH | TEMPLATE1, 2, 3 |
| LONELY | TEMPLATE8, 9 |
| UPBEAT | TEMPLATE1, 3, 6, 7 |
| ⋮ | ⋮ |

CONTENT DISTRIBUTING SERVER, CONTENT DISTRIBUTING METHOD, AND CONTENT DISTRIBUTING PROGRAM

BACKGROUND OF THE INVENTION

1. Field of the Invention

The present invention relates to a content distributing server and a content distributing method which distribute musical composition contents to terminal devices such as cellular mobile phones, as well as a content distributing program executed by a computer.

2. Description of the Related Art

Conventionally, there have been known servers which distribute to terminal devices contents (multimedia data) comprised of a wide variety of media data such as images, sound, and character strings, which can be reproduced and output by sounding, visual display, and so forth. In general, multimedia data is provided solely for viewing by users of terminal devices, and hence the users cannot, for example, edit the multimedia data. To obviate this, there has been developed a technique which provides multimedia data as a kind of template so that users can edit multimedia data to some extent.

For example, a server disclosed in Japanese Laid-Open Patent Publication (Kokai) No. 2004-007407 distributes to terminal devices such as cellular mobile phones a multimedia template file in which multimedia data is associated with editing operation setting data that prescribes the way of editing the multimedia data. An individual user operates a terminal device to carry out editing in which the template file can be modified within the range permitted by the editing operation setting data. For example, the user can select an image to be reproduced in predetermined timing from among a plurality of images and replace media data set to be reproduced in predetermined timing with other media data.

However, with the server disclosed in Japanese Laid-Open Patent Publication (Kokai) No. 2004-007407, users of terminal devices can select texts and images of templates and replace them by other texts and images but cannot dynamically modify the templates themselves. Thus, the distributing service provided by this server is little more than the so-called greeting service. Moreover, musical composition data distributed to users of terminal devices is generally restricted from being redistributed and modified, so that musical compositions adopted in the greeting service are limited and users of terminal devices cannot always acquire a template including a desired musical composition.

Thus, there is a problem that it is practically difficult for users to appropriately reproduce a desired moving video picture or the like in parallel with and in conformity with reproduction of a desired musical composition. For example, there may be cases where if a musical composition or a moving video picture or the like of a template is modified, a reproduction time length of the musical composition does not coincide with that of the moving video picture or the like. Also, there may be cases where a musical composition and a moving video picture or the like do not match in contents for example when the tune of the musical composition is upbeat whereas the tone color of the moving video picture or the like is dark or negative.

As described above, the conventional content distributing servers have the problem that it is difficult for users of terminal devices to display a desired moving video picture or the like in conformity with reproduction of a desired musical composition.

SUMMARY OF THE INVENTION

It is an object of the present invention to provide a content distributing server and a content distributing method which make it possible for terminal devices to reproduce desired display contents in conformity with reproduction of a desired musical composition in terms of time, as well as a content distributing program executed by a computer.

To attain the above object, in a first aspect of the present invention, there is provided a content distributing server comprising a musical composition storage device that stores a plurality of musical composition contents each prescribing a musical tone event sequence comprising musical tone event information, a template storage device that stores a plurality of template contents each prescribing a display control event sequence comprising display control event information, a communicating device that communicates with at least one terminal device, a musical composition identifying device that is responsive to a request from the terminal device via the communicating device, for identifying one musical composition content from the plurality of musical composition contents stored in the musical composition storage device, a template identifying device that is responsive to a request from the terminal device via the communicating device, for identifying one template content from the plurality of template contents stored in the template storage device, a time length adjusting device that adjusts a reproduction time length of the template content identified by the template identifying device according to a reproduction time length of the musical composition content identified by the musical composition identifying device, a synthesized content generating device that generates a synthesized content by adding the template content whose reproduction time length has been adjusted by the time length adjusting device to the musical composition content identified by the musical composition identifying device, and a content distributing device that distributes the synthesized content generated by the synthesized content generating device to the terminal device via the communicating device.

With the above arrangement, it is possible for terminal devices to reproduce desired display contents in conformity with reproduction of a desired musical composition in terms of time.

Preferably, the content distributing server comprises a list providing device that is responsive to a template content adding request from the terminal device via the communicating device, for creating a template list including at least one template content candidate that can be added to the identified musical composition content and transmitting the created template list to the terminal device.

More preferably, the musical composition content includes a lyric track, and the list providing device extracts at least one kind of word from the lyric track of the musical composition content identified by the musical composition identifying device and selects the at least one template content candidate based on the extracted word to create the template list.

Alternatively, the list providing device analyzes musical tone characteristics of the musical composition content identified by the musical composition identifying device, and selects the at least one template content candidate based on an analysis result to create the template list.

According to the above preferred arrangements, it is easy to select a template content suitable for the motif of music.

Preferably, each of the plurality of template contents includes a reproduction section including a first reproduction section in which a reproducing speed is required to be maintained at a constant speed, and a second reproduction section in which a reproducing speed is not required to be maintained at a constant speed, and the time length adjusting device changes only a reproduction time length of the second reproduction section of the template content identified by the template identifying device, to thereby adjust an entire reproduction time length of the identified template content.

More preferably, the reproduction section of each of the plurality of template contents is divided into an early section part, an intermediate section part, and a later section part in terms of time, the early and later section parts being the first reproduction section and the intermediate section part being the second reproduction section, and the time length adjusting device changes only a reproduction time length of the intermediate section of the template content identified by the template identifying device, to thereby adjust the entire reproduction time length of the identified template content.

More preferably, the reproduction time length of the intermediate section is changed by changing a reproduction time length of at least one display control event information at least partly included in the intermediate section of the template content identified by the template identifying device among display control event information constituting the display control event sequence prescribed by the identified template content so that a display ending time of the display control event information matches an ending time of the intermediate section.

Alternatively, the reproduction time length of the intermediate section is changed by changing a display starting time and a lifetime of at least one display control event information at least partly included in the intermediate section of the template content identified by the template identifying device among display control event information constituting the display control event sequence prescribed by the identified template content.

Alternatively, the reproduction time length of the intermediate section is changed by changing a display starting time, a lifetime, and time parameters of at least one display control event information at least partly included in the intermediate section of the template content identified by the template identifying device among display control event information constituting the display control event sequence prescribed by the identified template content.

Alternatively, the reproduction time length of the intermediate section is changed by repeatedly displaying at least one display control event information at least partly included in the intermediate section of the template content identified by the template identifying device among display control event information constituting the display control event sequence prescribed by the identified template content.

According to these preferred arrangements, it is possible to prevent effects on display contents corresponding to the introduction, ending, etc. of a musical composition content.

Preferably, the distributing server comprises a musical composition distributing device that distributes the musical composition content alone identified by the musical composition identifying device to the terminal device, a distribution result managing device that manages results of distribution by the musical composition distributing device and results of distribution by the content distributing device with respect to each of the at least one terminal device, and a charging device that charges based on the results of distribution managed by the distribution result managing device, wherein the charging device is responsive to distribution of a musical composition content alone by the musical composition distributing device, to charge for the distribution of the musical composition content.

More preferably, in a case where the content distributing device distributes the synthesized content, when the musical composition content identified by the musical composition identifying device is not a musical composition content distributed in the past, fees are charged for both distribution of the identified musical composition content and distribution of the template content added to the identified musical composition content, and when the musical composition content identified by the musical composition identifying device is a musical composition content distributed in the past, a fee is charged for only distribution of the added template content.

According to these preferred arrangements, it is easy to use musical composition contents in combination with an existing service.

To attain the above object, in a second aspect of the present invention, there is provided a content distributing method for a content distributing server comprising a musical composition storage device that stores a plurality of musical composition contents each prescribing a musical tone event sequence comprising musical tone event information, a template storage device that stores a plurality of template contents each prescribing a display control event sequence comprising display control event information, and a communicating device that communicates with at least one terminal device, the content distributing method comprising a, musical composition identifying step of, in response to a request from the terminal device via the communicating device, identifying one musical composition content from the plurality of musical composition contents stored in the musical composition storage device, a template identifying step of, in response to a request from the terminal device via the communicating device, identifying one template content from the plurality of template contents stored in the template storage device, a time length adjusting step of adjusting a reproduction time length of the template content identified in the template identifying step according to a reproduction time length of the musical composition content identified in the musical composition identifying step, a synthesized content generating step of generating a synthesized content by adding the template content whose reproduction time length has been adjusted in the time length adjusting step to the musical composition content identified in the musical composition identifying step, and a content distributing step of distributing the synthesized content generated in the synthesized content generating step to the terminal device via the communicating device.

Preferably, the content distributing method comprises a list providing step, in response to a template content adding request from the terminal device via the communicating device, creating a template list including at least one template content candidate that can be added to the identified musical composition content and transmitting the created template list to the terminal device.

Preferably, each of the plurality of template contents includes a reproduction section including a first reproduction section in which a reproducing speed is required to be maintained at a constant speed, and a second reproduction section in which a reproducing speed is not required to be maintained at a constant speed, and in the time length adjusting step, only a reproduction time length of the second reproduction section of the template content identified in the template identifying step is changed, to thereby adjust an entire reproduction time length of the identified template content.

Preferably, the content distributing method comprises a musical composition distributing step of distributing the musical composition content alone identified in the musical composition identifying step to the terminal device, a distribution result managing step of managing results of distribution by the musical composition distributing device and results of distribution in the content distributing step with respect to each of the at least one terminal device, and a charging step of charging based on the results of distribution managed in the distribution result managing step, wherein in the charging step, in response to distribution of a musical composition content alone in the musical composition distributing step, a fee is charged for the distribution of the musical composition content.

More preferably, in a case where the synthesized content is distributed in the content distributing step, when the musical composition content identified in the musical composition identifying step is not a musical composition content distributed in the past, fees are charged for both distribution of the identified musical composition content and distribution of the template content added to the identified musical composition content, and when the musical composition content identified in the musical composition identifying step is a musical composition content distributed in the past, a fee is charged for only distribution of the added template content.

To attain the above object, in a third aspect of the present invention, there is provided a content distributing program for causing a computer to execute the above described content distributing method.

The above and other objects, features, and advantages of the invention will become more apparent from the following detained description taken in conjunction with the accompanying drawings.

DETAILED DESCRIPTION OF THE PREFERRED EMBODIMENTS

The present invention will now be described in detail below with reference to the drawings showing preferred embodiments thereof.

Figure 1:
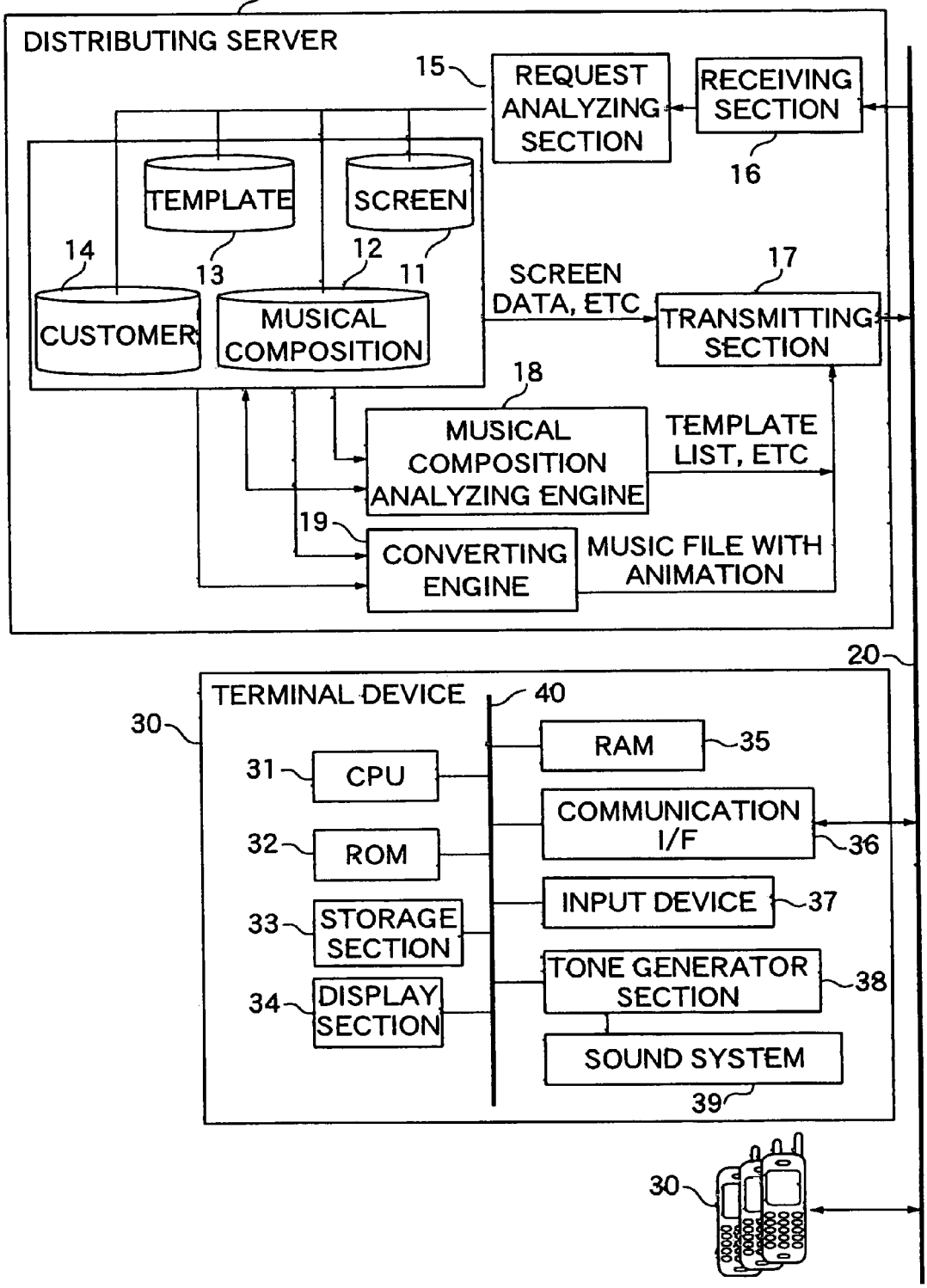
FIG. 1 is a block diagram showing the overall arrangement of a content distributing system including a content distributing server according to an embodiment of the present invention.

FIG. 1 is a block diagram showing the overall arrangement of a content distributing system including a content distributing server according to an embodiment of the present invention.

This system is comprised of the content distributing server 10 and a plurality of communication terminal devices (hereinafter referred to as "the distributing server" and "the terminal devices") 30. The terminal devices 30 are identical in construction and connected to the distributing server 10 via a communication line 20 for communication therewith.

The distributing server 10 stores various databases (hereinafter abbreviated to "DB"), i.e. a screen DB 11, a musical composition DB 12, a template DB 13, and a customer DB 14. The screen DB 11 stores page description files, icon images, and so forth that can be displayed in the terminal devices 30. The musical composition DB 12 (a musical composition storage device) stores a number of files mF of melodies with or without lyrics (hereinafter referred to as "musical composition files"), which can be reproduced by the terminal devices 30 in response to incoming calls, for example.

The template DB 13 (template storage device) stores a number of "template files tpF", described later, which are comprised of animations, freeze-frame pictures, moving video pictures, and so forth that can be displayed in the terminal devices 30, and "demo files" which are used for demonstration and correspond to the template files tpF. The customer DB 14 stores for every terminal device 30 results of distribution of musical composition files mF and music files with animation amF described later (e.g. date of distribution, the number of times of distribution, and point consumption status). The respective terminal devices 30 are identified and managed by telephone numbers.

A receiving section 16 (a communicating device) receives various requests transmitted from the terminal devices 30 via the communication line 20 and sends the received request to a request analyzing section 15. The request analyzing section 15 analyzes the request from the receiving section 16 and accesses required ones of the DBs 11 to 14 according to analysis results. Data of the analysis results are sent from the DBs to a transmitting section 17, a musical composition analyzing engine 18, or a converting engine 19. For example, screen data for screen display on the terminal devices 30, requested musical composition files mF, various menu lists, and so forth are sent to the transmitting section 17.

As will be described later, the musical composition analyzing engine 18 analyzes a musical composition file mF selected by the user of the terminal device 30, creates a template list conforming to the musical composition file mF, and sends the template list to the transmitting section 17. As will be described later, a converting engine 19 generates a music file with animation amF as a new file by adding a template file tpF to the musical composition file mF selected by the user of the terminal device 30 and sends the generated file amF to the transmitting section 17. The transmitting section 17 (communicating device, content distributing device, and musical composition distributing device) transmits the received data to the terminal device 30 via the communicating line 20. Although the term "music file with animation amF"

includes the word "animation" for the convenience of explanation, display data of a template file tpF should not necessarily be an animation but may also be either a freeze-frame picture or a moving video picture.

Although not illustrated, the distributing server 10 is equipped with storage devices such as a large-capacity hard disk, a RAM, and a ROM, as well as a CPU. The ROM stores control programs executed by the CPU. The DBs 11 to 14 are stored in the hard disk. The CPU cooperates with the storage devices to realize the functions of the request analyzing section 15 (musical composition identifying device and template identifying device), the musical composition analyzing engine 18 (list providing device), the converting engine 19 (time length adjusting device and synthesized content generating device), and so forth.

Next, a description will be given of one of the terminal devices 30 as a representative example of them. The terminal device 30 is comprised of a CPU 31 to which are connected, via a bus 40, a ROM 32, a storage section 33, a display section 34, a RAM 35, a communication interface (I/F) 36, an input device 37, and a tone generator section 38. A sound system 39 is connected to the tone generator section 38.

The terminal device 30 is implemented by, for example, a cellular mobile phone. The CPU 31 controls the overall operation of the terminal device 30. The ROM 32 stores firmware and various data for overall control of the terminal device 30. The storage section 33 is implemented by a non-volatile memory such as a flash memory and stores various downloaded data, control programs, and so forth. The display section 34 is comprised of, e.g., a liquid crystal display (LCD) for displaying various information such as images and characters. The RAM 35 temporarily stores flags and data.

The communication I/F 36 is capable of establishing connection with the communication line 20 and may be either wireless or wired. The input device 37 includes a plurality of operating elements such as a cursor key and a function key, for inputting information. The tone generator section 38 converts performance data such as musical composition files mF stored in the storage section 33 or RAM 35 to musical tone signals, and the sound system 38 converts the musical tone signals to sound.

Figure 2:
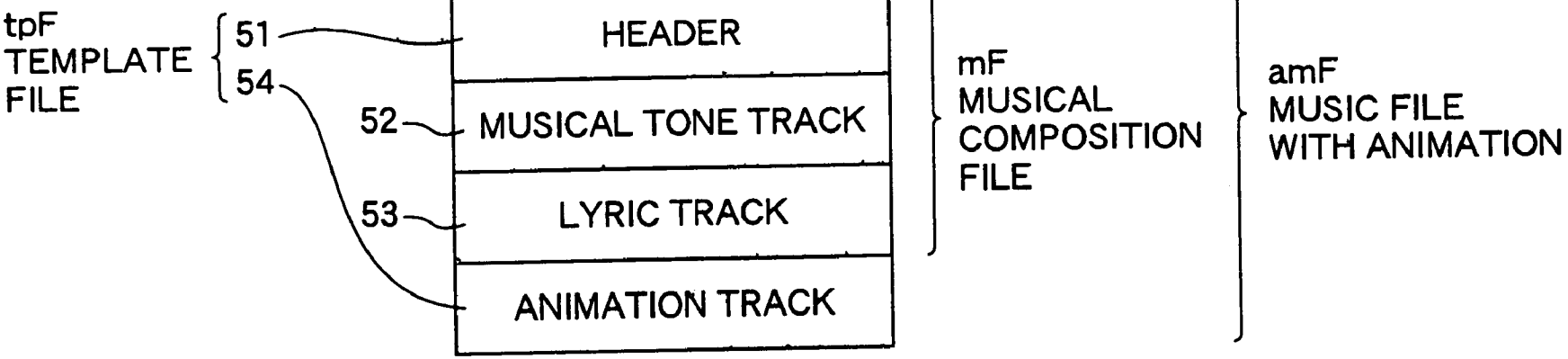
FIG. 2 is a conceptual diagram showing the data structure of a music file with animation.

FIG. 2 is a conceptual diagram showing the data structure of a music file with animation amF. The music file with animation amF is comprised of a header 51, a musical tone track 52, a lyric track 53, and an animation track 54. The music file with animation amF is created by adding a template file tpF to a music composition file mF, that is, synthesis of these two files. The original musical composition file mF (before synthesis) stored in the musical composition DB 12 is comprised of a musical composition content in which a musical tone event sequence comprised of a plurality of pieces of musical tone event information is prescribed. The original musical composition file mF typically includes data of a known format that is distributed for use as an incoming melody. Specifically, the musical composition file mF is in SMAF (Synthetic Music Mobile Application Format) (registered trademark) format, and includes a musical tone track 52 and a lyric track 53 as well as a header 51. Although not illustrated, the musical tone track 52 is comprised of a plurality of pieces of event data, gate time data indicative of the duration of sounding of each piece of event data, and so forth.

The original template file tpF stored in the template DB 13 is a template content prescribing a display control event sequence, is similar in format to the musical composition file mF, and is comprised of an animation track 54 as well as a header 51. The animation track 54 is comprised of a plurality of pieces of display event data ev, described later with reference to FIG. 7, gate time data indicative of the duration of sounding of each piece of display event data, and so forth. The reproduction time length of the original template file tpF is set to, for example, about 10 to 30 seconds.

The header 51 of the music file with animation amF is not identical with the header 51 of the original music file mF or the header 51 of the original template file tpF, but is a combination of the contents of the headers 51 of both the original music file mF and the original template file tpF. The header 51 of the music file with animation amF includes various information such as file size information and track information (the title and genre of a music composition, the title of an animation, a writer, and tempo data indicative of the performance tempo of the entire musical composition).

Figure 3:
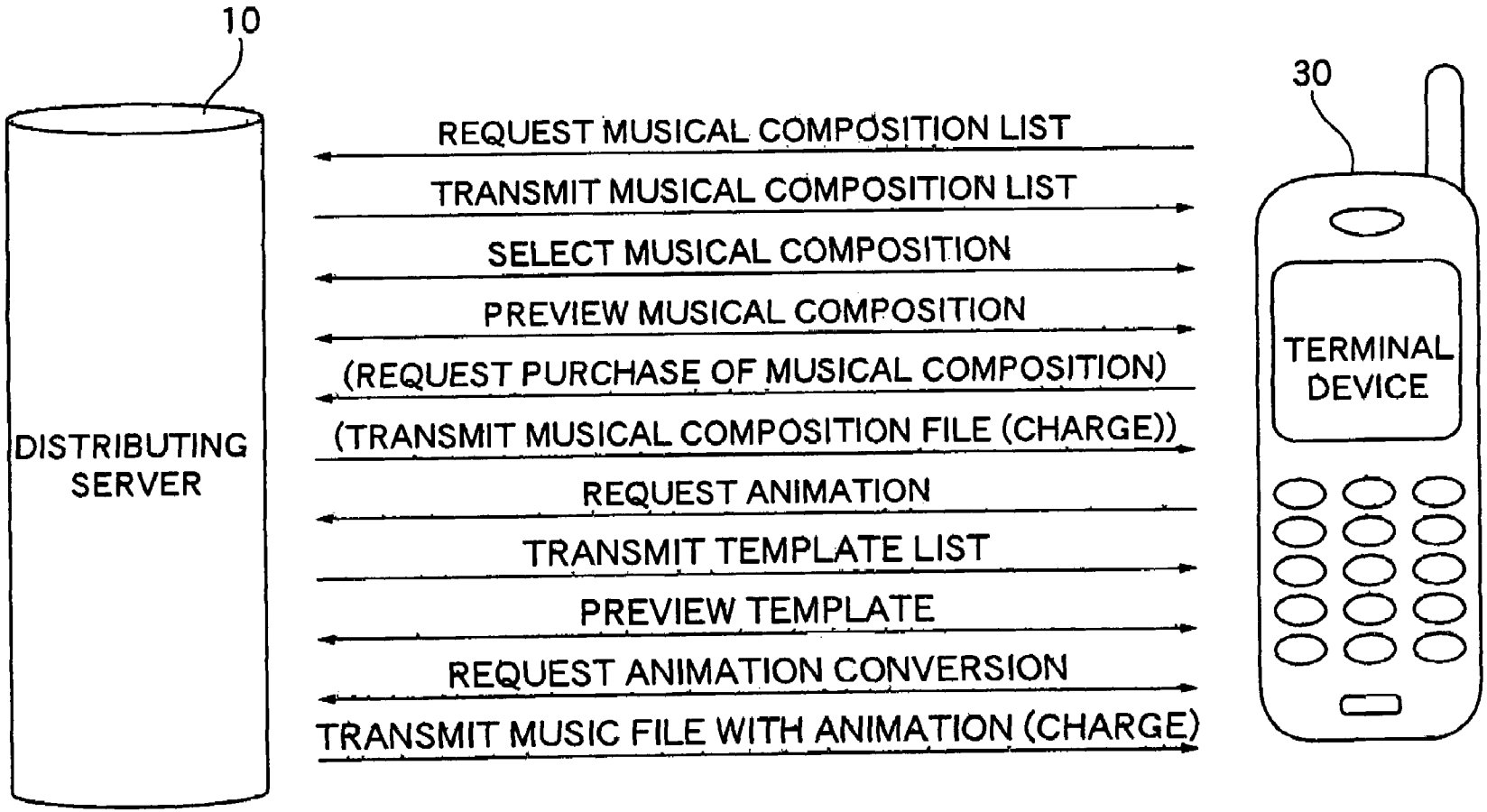
FIG. 3 is a diagram showing an example of the way of communication between a distributing server and a terminal device.

FIG. 3 is a diagram showing an example of how the distributing server 10 and the terminal device 30 carry out communications. When purchasing a musical composition (musical composition file mF) from the distributing server 10, or purchasing a music file with animation amF used for reproduction of a musical composition and display of an animation or the like, the user of the terminal device 30 communicates with the distributing server 10 according to the procedure described below.

First, when the terminal device 30 sets conditions such as a music genre and a new album and requests transmission of a musical composition list, the distributing server 10 responds thereto and transmits a musical composition list to the terminal device 30. In response to operation by the user, the terminal device 30 selects a desired musical composition from the musical composition list and notifies the selection to the distributing server 10, so that the selected musical composition can be previewed. In purchasing the musical composition alone (without creating a music file with animation amF from the musical composition), the selected musical composition is downloaded into the terminal device 30 by sending a request to purchase the musical composition to the distributing server 10. On this occasion, a result of distribution indicating which musical composition has been purchased by the terminal device 30 is recorded in the customer DB 14 (see FIG. 1; distribution result managing device and charging device) of the distributing server 10, and a fee (for example, two points) is charged for the purchase of the musical composition.

In the case where a musical composition alone is purchased, the communication and processing are carried out in the conventional way.

The remainder of the procedure will be briefly described with reference to FIG. 3 and described in detail with reference to FIGS. 4 to 11.

When the terminal device 30 requests the distributing server 10 to add a template file tpF to the musical composition the user intends to purchase at present or to a musical composition the user purchased in the past (i.e. when an animating request is made), the distributing server 10 creates a template list suitable for the concerned musical composition and sends it to the terminal device 30. In the template list, there are shown one or more template files tpF (template content candidates) that can be added to the musical composition.

The terminal device 30 can select a desired template file tpF from the received template list and preview it as necessary. For the preview, data corresponding to the selected template file tpF is used, which can be downloaded free of charge from the distributing server 10.

After selecting one desired template file tpF, the terminal device 30 makes an animation conversion request, i.e., a request to adjust the reproduction time length of the template file tpF and actually add the adjusted template file tpF to the concerned musical composition. On this occasion, the distributing server 10 adjusts the reproduction time length of the template file tpF in conformity with the musical composition file mF (detailed description thereof will be given later with reference to FIGS. 7 to 11). The distributing server 10 then generates a music file with animation amF by adding the template file tpF of which reproduction time has been adjusted to the musical composition file mF, and distributes the generated music file with animation amF to the terminal device 30 which is the source of the request.

When the terminal device 30 downloads the music file with animation amF, the customer DB 14 of the distributing server 10 records the fact that the terminal device 30 has purchased the music file with animation amF and a result of distribution indicating which music composition file mF and template file tpF constitute the music file with animation amF. The distributing server 10 charges a fee for the purchase (for example, three points). If, however, the musical composition file mF constituting the music file with animation amF was downloaded in the past into the terminal device 30, a fee (for example, one point) is charged for only the template file tpF.

The distributing server 10 may, for example, provide a service for which each individual user pays a fixed monthly fee. In this service, predetermined "points" are given to each user, and the service is available with payment within the range of points the user has. When a file is downloaded (purchased), "points" are consumed. Upon receiving a downloading request, the distributing server 10 refers to the customer DB 14 to check whether or not enough user's points are left. If enough points are not left, a screen showing the message that "The service cannot be provided because enough points are not left" is sent to the terminal device 30.

Figure 4:
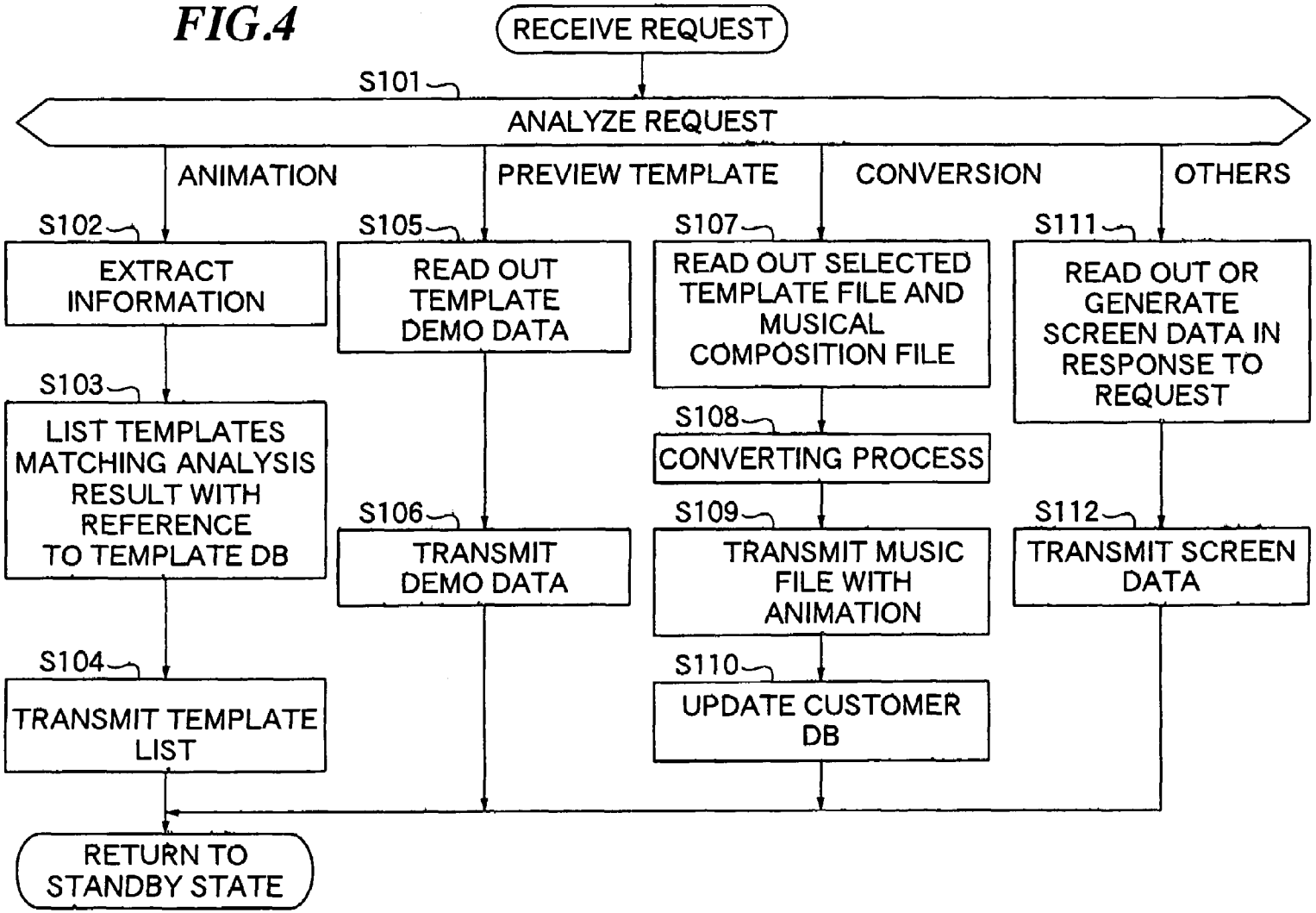
FIG. 4 is a flowchart showing a request receiving process carried out by the distributing server.
Figure 5:
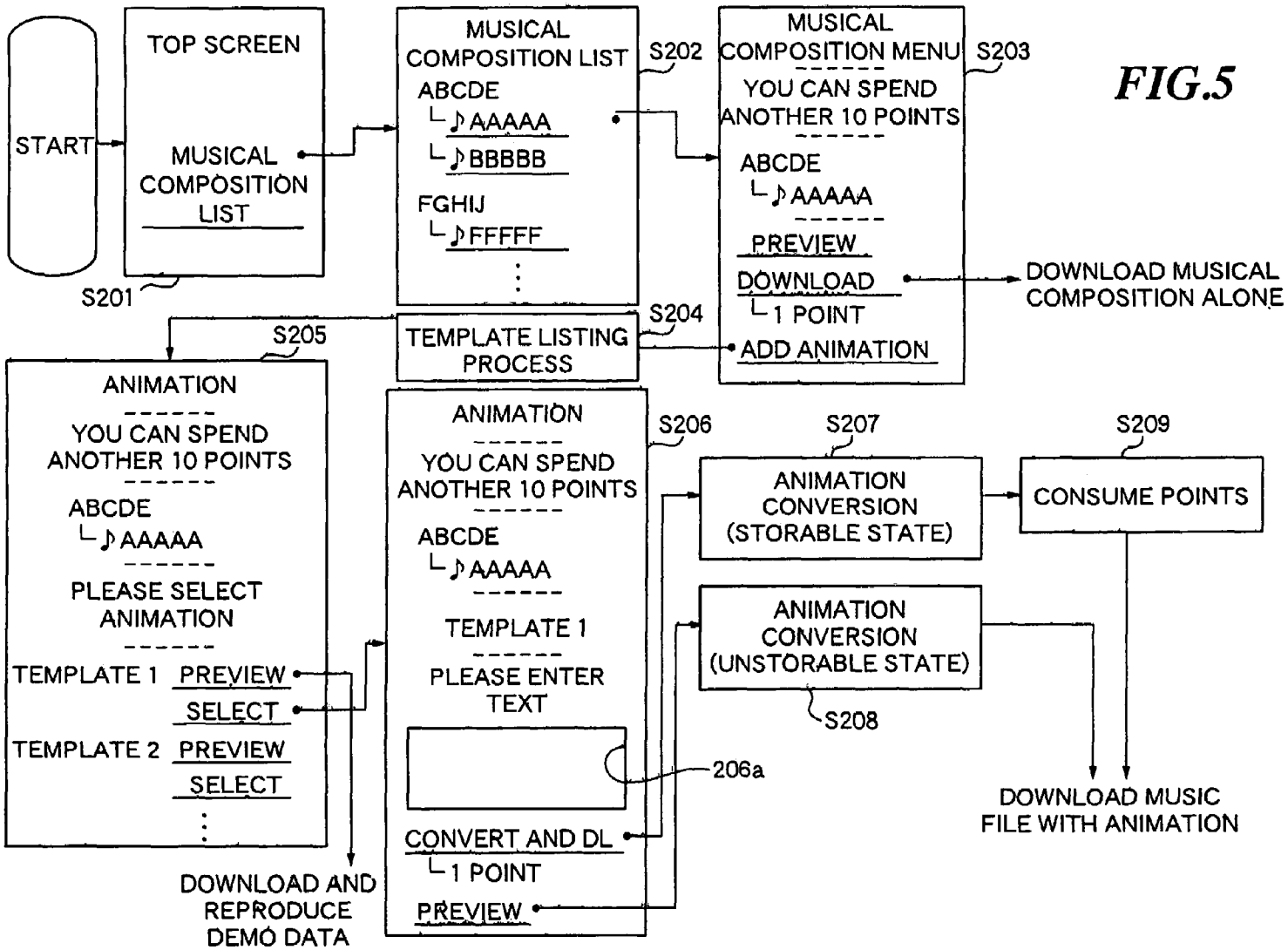
FIG. 5 is a transition diagram showing screens displayed in a display section of the terminal device and a process carried out by the distributing server with the progress of the request receiving process in FIG. 4.

FIG. 4 is a flowchart showing a request receiving process carried out by the distributing server 10. The distributing server 10 is on standby all the time, and carries out the process each time it receives a request from any of the terminal devices 30. FIG. 5 is a transition diagram showing screens displayed in the display section 34 (see FIG. 1) of the terminal device 30 and the corresponding process carried out by the distributing server 10 with the progress of the request receiving process in FIG. 4.

It should be noted that the distributing server 10 is capable of simultaneously communicating with a plurality of terminal devices 30, but in the following, the way of handling a request from one terminal device 30 and corresponding screen displays on the terminal device 30 will be described.

First, as shown in FIG. 4, when a request from the terminal device 30 is received, the request analyzing section 15 analyzes the request to determine whether the request is an animating request, a template previewing request, an animation conversion request, or any other type of request (step S101). If it is determined that there is any other type of request, screen data suitable for the request is read out from the screen DB 11 or newly generated (step S111). Examples of such request include a request to access a top screen, a request to request transmission of a musical composition list, a request to select a musical composition, a request to preview a musical composition, and a request to purchase a musical composition (see FIG. 3). The distributing server 10 transmits the readout or generated screen data to the terminal device 30 which is the source of the request (step S112), and returns to the standby state.

As shown in FIG. 5, a musical composition list, for example, is selected on a top screen of the terminal device 30. When a decision key, not shown, on the top screen is depressed (hereinafter referred to as "turned ON") (step S201), the musical composition list is screen displayed (S202). When a desired musical composition is selected and turned ON on the screen, the process proceeds to a step S203 wherein a request to preview, download, or animate the selected musical composition can be made. If "Download" is turned ON, the intention of purchasing the selected musical composition is indicated. In this case, as described above, the distributing server 10 distributes the musical composition, records the result of distribution, and charges the terminal device 30 two points for the purchase of the musical composition.

Referring again to FIG. 4, if it is determined in the step S101 that the request is an animating request, the analyzing engine 18 extracts information from a musical composition file mF that is currently an animation object (hereinafter referred to as "musical composition to be animated") in order to analyze the musical composition to be animated (step S102).

Figures 6A, 6B:
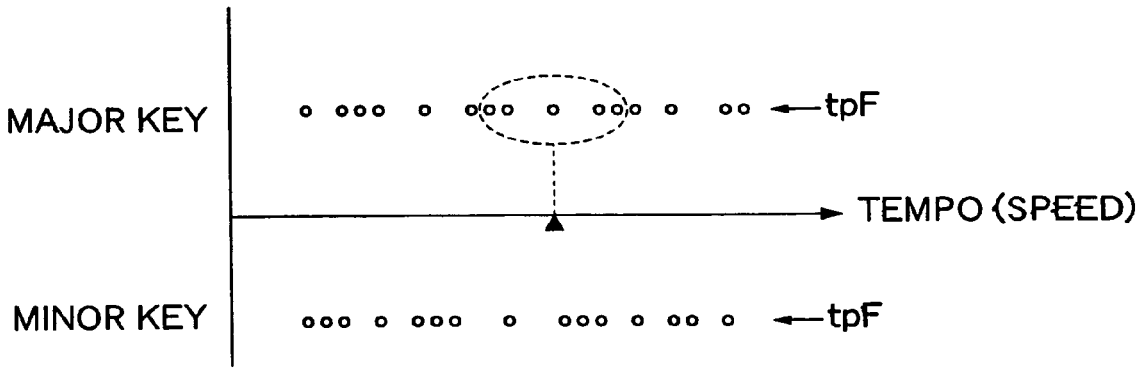
FIG. 6A is a conceptual diagram showing a keyword-and-template table referred to in creating a template list.
FIG. 6B is a conceptual diagram showing a musical tone characteristics-and-template table (map) referred to in creating a template list.

FIG. 6A is a conceptual diagram of a keyword-and-template table that is referred to in creating a template list. FIG. 6B is a conceptual diagram of a tone characteristic-and-template table (map) referred to in creating a template list. These tables are stored in, for example, the template DB 13 of the distributing server 10 or any of the above-mentioned storage devices, not shown.

The keyword-and-template table in FIG. 6A includes keywords such as "Beach" and "Lonely" each of which is associated with one or more template files tpF that conceptually match the keyword. For example, templates 1, 2, and 3 are associated with the keyword "Beach." It should be noted that one template file tpF may be associated with a plurality of different keywords. On the other hand, the musical tone characteristic-and-template table in FIG. 6B includes a plurality of template files tpF that are two-dimensionally arranged as indicated by circles in FIG. 6B in association with keys (a minor key and a major key) and tempos of musical compositions. For example, template files tpF are arranged such that they conceptually match keys and tempos; a high-keyed animation for the major key, and an animation having a nimble feel for a high tempo.

Which of the above tables is to be used may be set by default, but may be determined by the user of the terminal device 30. In the case where which of the tables is to be used is determined by the user, a screen for prompting the user to select "Keyword" or "Tune" may be displayed in response to, for example, an animating request.

In the case where in the step S102 the keyword-and-template table in FIG. 6A is used in creating a template list, text information is extracted from the lyric track 53 (see FIG. 2) of the musical composition to be animated, and words that occur in the extracted text information are then extracted from the text information. A predetermined number of higher-ranked words sorted in descending order of occurrence frequency are regarded as keywords. It should be noted that the word extraction from a lyric track can be carried out using a known method as described in Japanese Laid-Open Patent Publication (Kokai) No. 2001-34275, for example.

On the other hand, in the case where in the step S102 the musical tone characteristic-and-template table in FIG. 6B is used, the musical tone track 52 (see FIG. 2) of the musical composition to be animated is analyzed to detect the key of the musical composition to be animated, and tempo data is extracted from the header 51. It should be noted that the extraction of the key of a musical composition can be made using a known method as described in Japanese Laid-Open Patent Publication (Kokai) No. 2002-156969, for example.

Next, in a step S103 in FIG. 4, a template list is made by listing one or more template files tpF that match the result of the analysis in the step S102. Specifically, in the case where the keyword-and-template table is used, one or more template files tpF corresponding to the extracted keywords are identified with reference to the keyword-and-template table. The number of template files tpF to be identified may be limited; for example, template files tpF corresponding to higher-ranked keywords are preferentially identified, and when the number of template files tpF exceeds a predetermined number (for example, ten), lower-ranked keywords may be ignored.

On the other hand, in the case where the musical tone characteristic-and-template table is used, one or more template files tpF arranged at positions close to an intersection determined by the detected key and the extracted tempo data are identified in the table. In this case, those template files closer to the intersection may be sequentially adopted as identified template files tpF until the number of identified template files tpF exceeds a predetermined number.

The identified template files tpF are then listed to make a template list. The distributing server 10 transmits the template list (screen data indicative of the template list) to the terminal device 30 which is the source of the request (step S104), and returns to the standby state.

The processes in the steps S102 to S105 in FIG. 4 correspond to a template animating process in a step S204 in FIG. 5. The template animating process is carried out by the distributing server 10 after "Add animation" is turned ON on the display screen shown in the step S203 in FIG. 5. When the terminal device 30 receives the template list, the process proceeds to a step S205 wherein the template list is screen displayed. On the screen, the user can preview or select any of the listed template files tpF. If "Preview" is turned ON, it is determined in the step S101 in FIG. 5 that the request is a template previewing request, and the converting engine 19 (see FIG. 1) reads out from the template DB 13 demo data corresponding to the template file tpF selected to be previewed (step S105). The distributing server 10 then sends the demo data to the terminal device 30 (step S106) and returns to the standby state.

When the demo data is downloaded into the terminal device 30, it is automatically or manually reproduced in the terminal device 30. Demo data is comprised of a template file tpF and a predetermined musical composition file associated therewith. At the same time when musical tones for demonstration are generated, an animation or the like is displayed in the display section 34.

On the other hand, when "Select" is turned ON on the screen showing the template list displayed in the step S205, a screen is displayed for requesting conversion of the selected template file tpF or previewing a music file with animation amF after conversion (step S206). On this screen, the user can enter characters, image, or the like into a small screen 206*a*, as desired. The content thus entered is associated with a completed music file with animation amF, and for example, is used when the user identifies and manages a plurality of music file with animation amFs.

When "Convert and DL (download") or "Preview" is turned ON on the screen displayed in the step S206, it is determined in the step S101 in FIG. 4 that the request is a request to carry out conversion of the selected template file tpF, and thus the process proceeds to a step S107. In the step S107, the converting engine 19 reads out the selected template file tpF and the musical composition to be animated (musical composition file mF) from the template DB 13 and the musical composition DB 12, respectively. The musical composition file MF is read out even if it was distributed to the same terminal device 30 in the past.

In the next step S108, the converting engine 19 carries out a converting process. Specifically, the converting engine 19 adjusts the reproduction time length of the readout template file tpF and adds the adjusted template file tpF to the readout musical composition file mF to thereby generate a music file with animation amF. This converting process will be described later with reference to FIGS. 7 to 11. In the step S108, when the converting process is carried out in response to turning-on of "Convert and DL" on the screen displayed in the step S206, a "storable flag" is added to the generated music file with animation amF (step S207 in FIG. 5). On the other hand, when the converting process is carried out in response to turning-on of "Preview", an "unstorable flag" is added to the generated music file with animation amF (step S208).

Next, the transmitting section 17 transmits the generated music file with animation amF (with the storable flag or unstorable flag) to the terminal device 30 which is the source of the request (step S109), and the distributing server 10 returns to the standby state. The terminal device 30 that has downloaded the music file with animation amF can store the music file with animation amF in the storage section 33 (see FIG. 1) only when the storable flag is attached to it. The music file with animation amF to which the unstorable flag is attached can merely be previewed (musical tone reproduction and display reproduction).

When distributing the music file with animation amF to which the storable flag is attached, the distributing server 10 updates the contents (past results of distribution) of the customer DB 14 of the terminal device 30 which is the destination of the music file with animation amF. Along with this, the distributing server 10 charges the terminal device 30 for the distribution service (step S209). In this case, if a template file tpF is added to a musical composition file mF to be purchased for the first time, a total of three points are charged, but if a template file tpF is added to a musical composition file mF distributed in the past, one point is charged for only the template file tpF. It should be noted that when the music file with animation amF to which the unstorable flag is attached is distributed, the customer DB 14 is not updated, and the terminal device 30 is not charged.

Figure 7:
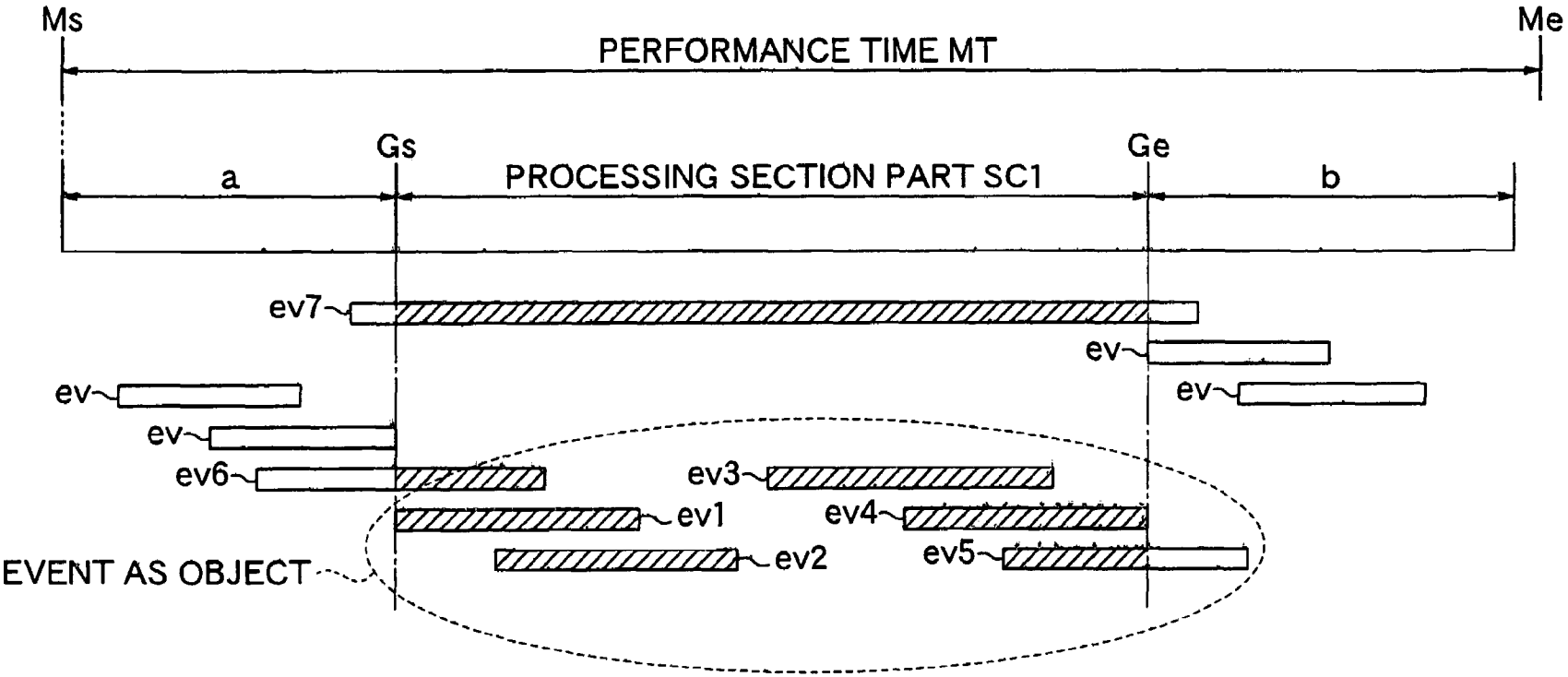
FIG. 7 is a timing chart showing in chronologic order a musical composition file and a plurality of pieces of display event data in an animation track of a template file.

A description will now be given of the converting process in the step S108. FIG. 7 is a timing chart showing in chronological order a musical composition file mF and a plurality of pieces of display event data ev in the animation track 54 of a template file tpF. The durations for which display event data ev (including display event data ev1 to ev7) are displayed from their display starting times to their display ending times are expressed by lengths.

The reproduction section of the template file tpF illustrated in FIG. 7 is comprised of a early section part a including prologue display, a later section part b including finale display, and a processing section part SC1 between the section parts a and b. The early and later section parts a and b (first reproduction section) include prorogue display and finale display, respectively, and hence in the section parts a and b, the reproducing speed has to be maintained at a constant speed. On the other hand, in the processing section part SC1 (second reproduction section), the reproducing speed does not have to be maintained at a constant speed.

The reproduction time length of the entire template file tpF before time adjustment is the sum of the time lengths of the following three section parts, e.g. about 10 to 30 seconds as mentioned above: the early section part a from a reproduction starting time to a processing section starting time Gs, and the processing section part SC1 that is an intermediate section part from the processing section starting time Gs to a processing section ending time Ge, and the later section part b from the processing section ending time Ge to a reproduction ending time. The time length of the early section part a is, for example, about two seconds, and the time length of the later section part b is, for example, about ten seconds. The time lengths of these two section parts vary according to template files tpF.

On the other hand, as shown in the upper part of FIG. 7, the reproduction time length of the musical composition file mF to which the template file tpF is to be added is "performance time MT" from a reproduction starting time Ms to a reproduction ending time Me. The performance time MT is found by adding up gate times of event data of the musical composition file mF or by referring to reproducing time information included in the header 51. The reproduction time length of the template file tpF (a+SC1+b) and the performance time MT do not necessarily coincide, and hence the reproduction time length of the template file tpF is adjusted, i.e. extended or reduced so as to coincide with that of the performance time MT.

On this occasion, only the reproduction time length of the processing section part SC1 is adjusted so that the reproduction time length of the entire template file tpF is made coincide with the performance time MT. The reproduction time lengths of the early and later section parts a and b are not adjusted since in the section parts a and b, the reproducing speed has to be maintained at a constant speed for the reason described above. Specifically, display event data ev (display control event information) whose display is at least partly carried out in the processing section part SC1 is an object of adjustment. In the illustrated example, the display event data ev1 to ev7 are objects of adjustment.

In this example, the display event data ev1 to ev4 are included in the processing section part SC1 in their entireties from display starting times to display ending times, and hence the entire of each of the display event data ev1 to ev4 is adjusted in conformity with adjustment of the reproduction time length of the template file tpF. On the other hand, the display event data ev5 to ev7 are not included fully from display starting times to display ending times but partly included in the processing section part SC1. Specifically, only those portions of the display event data ev5 to ev7 which are included in the processing section part SC1 are adjusted in conformity with adjustment of the reproduction time length of the template file tpF.

For example, in the case where the reproduction time length of the template file tpF is extended, the display starting time of the display event data ev5 is made delayed, and the duration for which the display event data ev5 is displayed is made to increase. The duration for which the display event data ev6 is displayed is made to increase, but the display starting time of the display event data ev6 is kept unchanged. The display starting time of the display event data ev7 is not changed, but the duration for which the display event data ev7 is displayed is increased by an amount corresponding to a change in the time length of the processing section part SC1.

Each piece of display event data ev is prescribed such that an object displayed is moved and scenes, colors, and patterns are varied on a screen. For example, each piece of display event data ev prescribes the display content such that an object displayed, e.g., a cloud in the sky, moves at a predetermined speed from a starting position to a terminating position while changing its shape. In the following description, the duration for which each piece of display event data ev is displayed will be referred to as "the lifetime."

FIGS. 8 to 11 are diagrams showing examples of conversion patterns in time length adjustment. In each figure, a musical composition file mF is illustrated in the upper part, a template file tpF before conversion is illustrated below the musical composition file mF, and a template file tpF after conversion is illustrated in the lower part. In the description of each conversion pattern, it is assumed that a musical composition file mF is longer than a template file tpF before adjustment.

Figure 8:
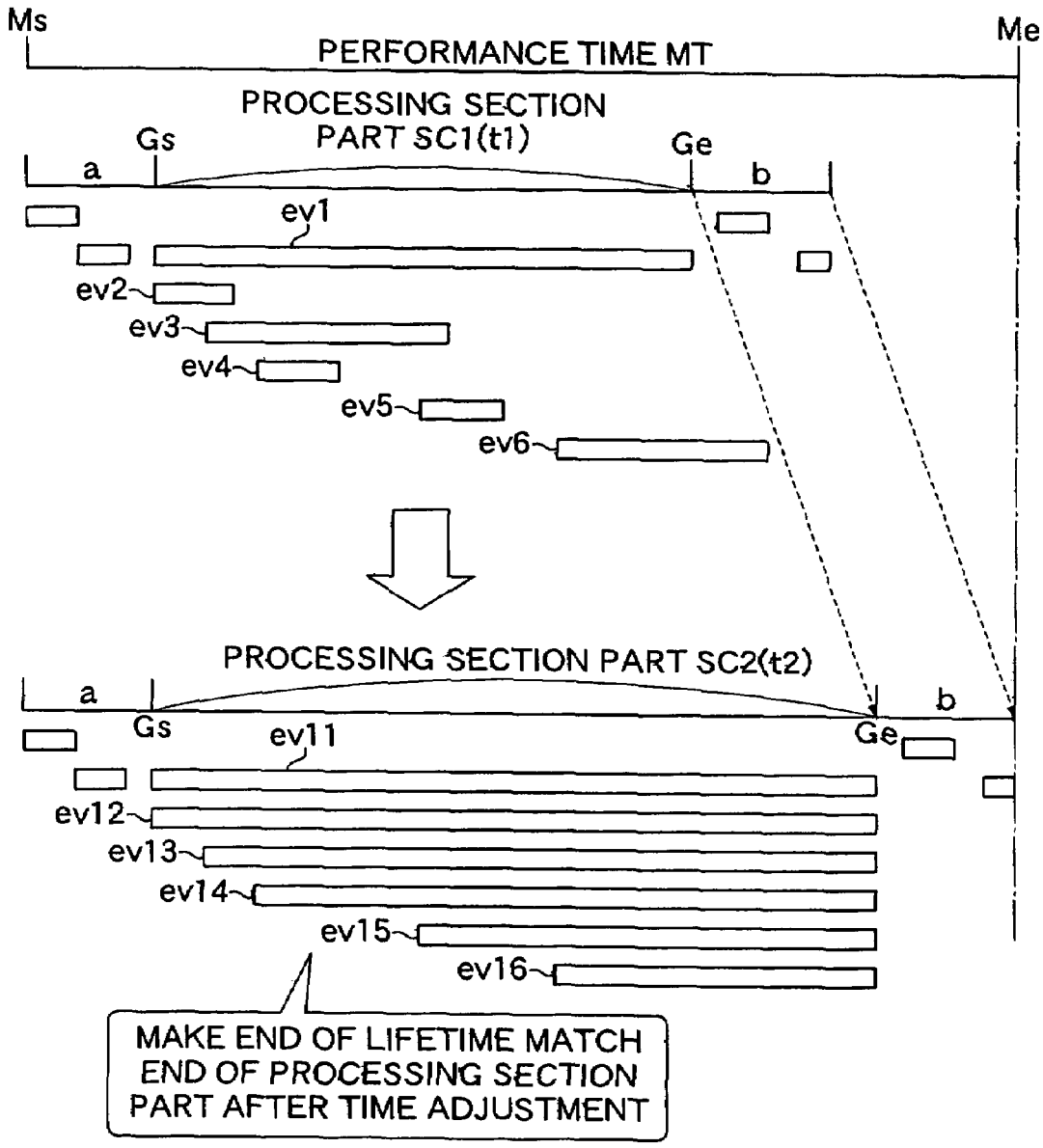
FIG. 8 is a diagram showing an example of a first conversion pattern for time length adjustment.

First, in a first conversion pattern in FIG. 8, a processing section part SC1 with a time length t1 is extended to be a processing section part SC2 with a time length t2, so that MT=a+SC2(t2)+b. Then, with respect to all the display event data ev1 to ev6 in the processing section part SC1, display ending times are converted into those matching a processing section ending time Ge of the processing section part SC2 (display event data evil to ev16). As a result, the lifetimes are increased, and display of all the display event data evil to ev16 ends simultaneously at the processing section ending time Ge.

Assuming that one piece of the display event data ev as an object of conversion is data which prescribes the contents of display that "a cloud in the sky moves at a predetermined speed from a starting position to a terminating position while changing its shape", the template file tpF includes operating time-related parameters which prescribe the speed at which the shape of the cloud changes and the speed at which the cloud moves. However, in the first conversion pattern, only the display ending time is delayed, so that the operating time-related parameters are kept unchanged, and therefore, the speed at which the shape of the cloud changes and the speed at which the cloud moves do not change. Thus, even if the cloud moves from the starting position to the terminating position over the entire lifetime in accordance with the display event data ev before conversion, the display event data ev after conversion is such that the cloud reaches the terminating position before the extended lifetime ends and is then kept at a standstill at the terminating position until the lifetime ends. This is displayed in the terminal device 30.

In this connection, display event data ev of which display starting time is not included in the processing section part SC1 is displayed in the same way and timing as those in which the original template file tpF is displayed.

Figure 9:
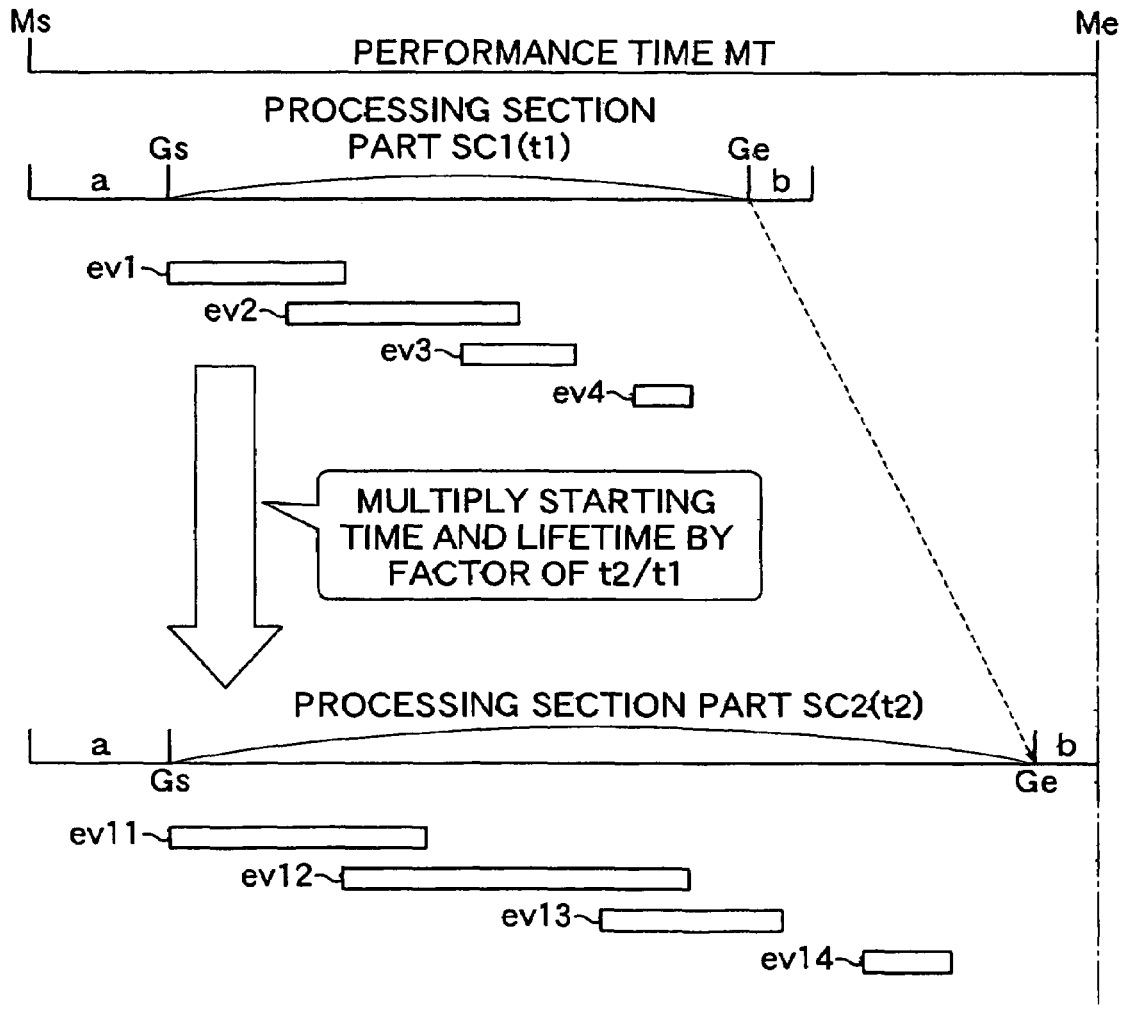
FIG. 9 is a diagram showing an example of a second conversion pattern for time length adjustment.

In a second conversion pattern in FIG. 9, as is the case with the first conversion pattern, a processing section part SC1 (time length t1) is extended to be a processing section part SC2 (time length t2). Then, with respect to all the display event data ev1 to ev4 in the processing section part SC1, the lengths of time from a processing section starting time Gs to display starting times and the lifetimes are extended by a factor of t2/t1 (display event data ev11 to ev14). As a result, the lengths of time from display ending times to a processing section ending time Ge are also extended by a factor of t2/t1.

In the second conversion pattern as well, the operating time-related parameters are not changed, and hence in the example where a cloud moves in the sky, the speed at which the shape of the cloud changes and the speed at which the cloud moves are not changed. Thus, even if the cloud moves from a starting position to a terminating position over the entire lifetime before data conversion, the display event data ev after conversion is such that the cloud appears on the screen at a time delayed by a factor of t2/t1, reaches the terminating position before the extended lifetime ends, and is kept at a standstill at the terminating position until the lifetime ends.

Figure 10:
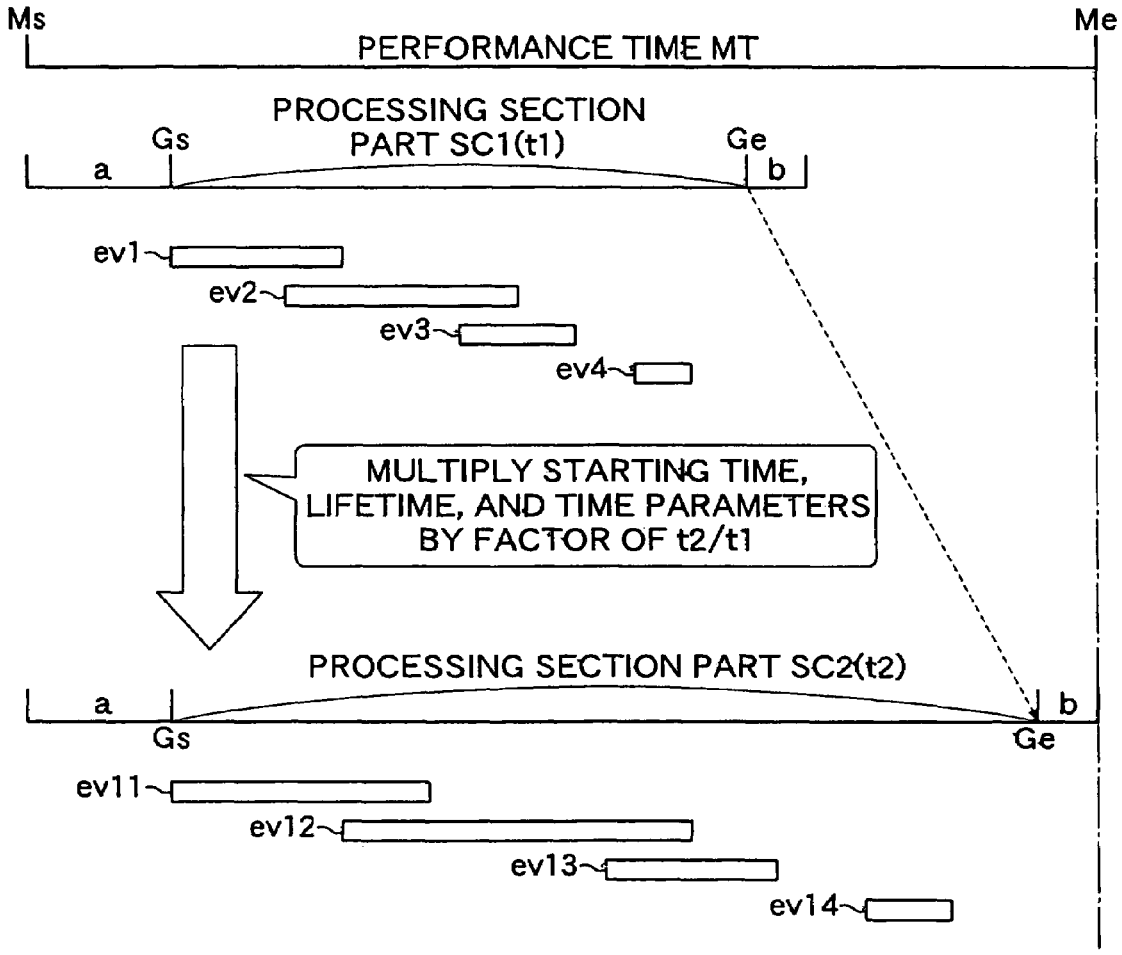
FIG. 10 is a diagram showing an example of a third conversion pattern for time length adjustment.

In a third conversion pattern shown in FIG. 10, the processing in the second conversion pattern in FIG. 9 is carried out, and in addition, the operating time-related parameters are adjusted by a ratio of t1 to t2 (display event data ev11 to ev14).

In this case, the operating speed is adjusted to be delayed by a factor of t1/t2. The lifetime is extended by a factor of t2/t1.

In the third conversion pattern where the operating time-related parameters are changed as well, the speed at which the shape of the cloud changes and the speed at which the cloud moves are delayed by a factor of t1/t2 in the example where the cloud moves in the sky. Thus, if the cloud moves from a starting position to a terminating position over the entire lifetime before data conversion, the display event data ev after conversion is such that the cloud appears on the screen at a time delayed by a factor of t2/t1 and moves (more slowly than before the data conversion) from the starting position to the terminating position over the entire extended lifetime than before the data conversion while changing its shape more slowly than before conversion.

In the third conversion pattern, as for those display event data ev which are not included fully from the display starting times to the display ending times but are partly included in the processing section part SC1 as with the display event data ev5 to ev7 shown in FIG. 7, the operating time-related parameters are adjusted with respect to only data portions included in the processing section part SC according to the lifetime of each display event data ev after time adjustment, as described with reference to FIG. 7.

Figure 11:
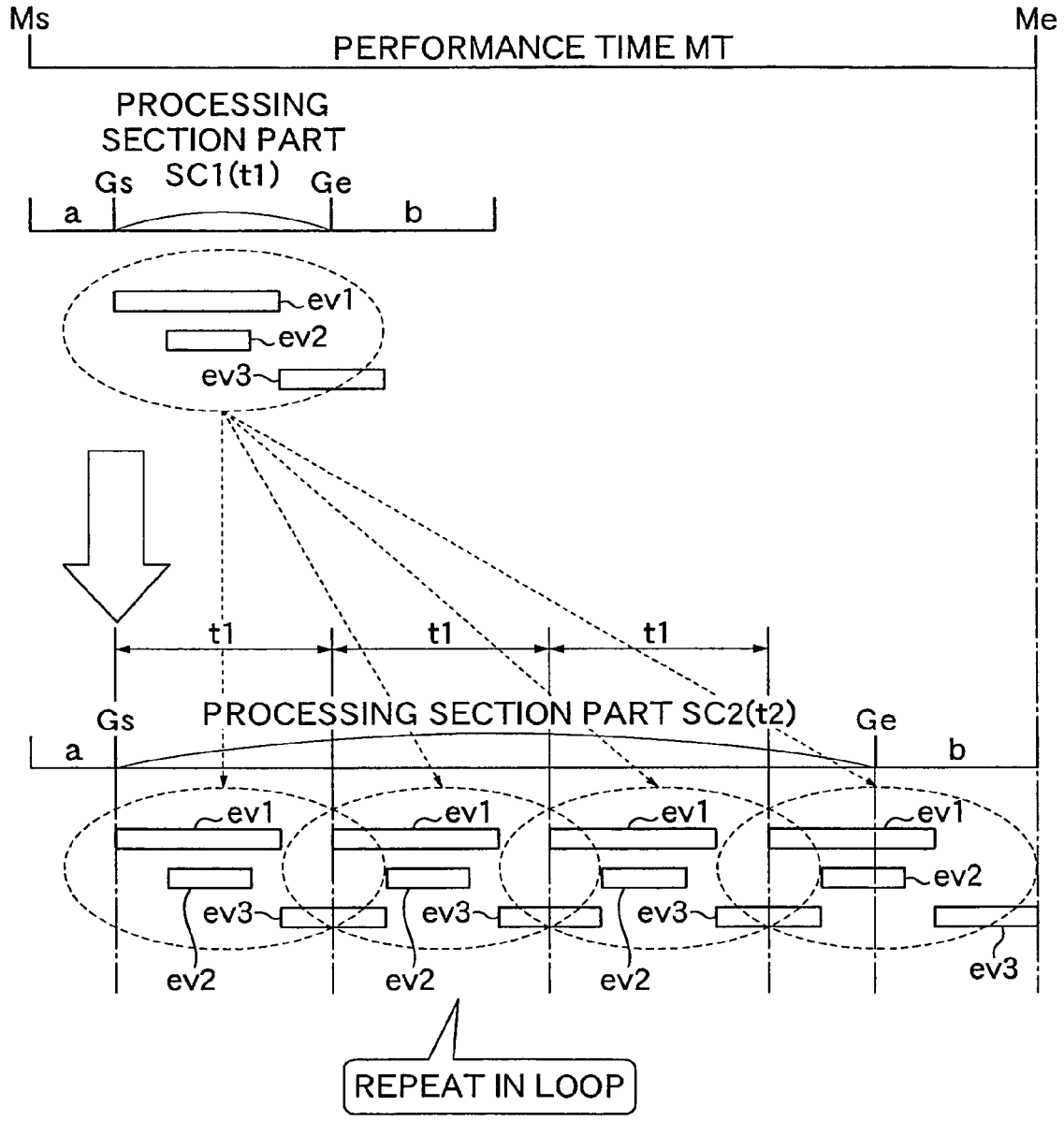
FIG. 11 is a diagram showing an example of a fourth conversion pattern for time length adjustment.

In a fourth conversion pattern in FIG. 11, as with the first conversion pattern, a processing section part SC1 (time length t1) is extended to be a processing section part SC2 (time length t2). Then, all the display event data ev1 to ev3 in the processing section part SC1 are repeatedly displayed in the processing section part SC2 without changing their lifetimes (loop).

Specifically, the processing section part SC2 is divided from the beginning into section portions at intervals of a time length t1 which is the same as the time length t1 of the processing section part SC1. In each of the section portions, the display event data ev1 to ev3 are displayed in the same way as that in which the processing section part SC1 is displayed. That is, the length of time from the beginning of each section portion to the display starting time is identical with the length of time from the beginning of the processing section part SC1 to the display starting time. The display event data ev3 spans two adjacent section portions and hence does not end at the terminating point of the preceding section portion but continues to be displayed from the preceding section portion to the succeeding section portion to complete its lifetime.

The final section portion may be shorter than the time length t1. In the final section portion, only display event data ev (in the illustrated example, ev1 and ev2) of which display starting times have been reached are displayed, and display event data ev of which display starting times have not been reached (in the illustrated example, display event data ev3) are not displayed. Also, display event data ev having once been displayed (ev1 and ev2) are displayed to complete their lifetimes even after the processing section ending time Ge. It should be noted that display of the display event data ev (ev1 and ev2) may be terminated when the processing section ending time Ge is reached. Also, the display event data ev3 may be displayed, if its display starting time comes before the reproduction of the entire template file tpF is completed.

In the step S108 in FIG. 4, the converting process is carried out using any of the above four conversion patterns. The conversion pattern to be adopted may be set (for example, to the third conversion pattern) by default. Alternatively, the conversion pattern to be adopted may be determined by the user of the terminal device 30. In this case, for example, immediately after "Convert and DL" or "Preview" is turned ON in the step S206 in FIG. 5, a screen for prompting the user to select a conversion pattern may be displayed to accept user's selection.

It should be noted that when a musical composition file mF is shorter than a template file tpF before adjustment, various parameters of display event data ev may be converted in such directions as to reduce the time length of a processing section part SC1 conversely to the examples shown in FIGS. 8 to 11.

According to the present embodiment, a music file with animation amF is distributed that is created by adding a template file tpF to a musical composition file mF to meet the preference of the user of the terminal device 30, and the length of time that the template file tpF is displayed is adjusted to match the length of time that the musical composition file mF is reproduced. Thus, the user of the terminal device 30 can cause the times at which display starts and ends to match the times at which reproduction of a musical composition starts and ends. Thus, desired display contents can be reproduced in conformity with reproduction of a desired musical composition in terms of time.

Also, since a template list is created based on keywords in a musical composition to be animated or the key and tempo of a musical composition to be animated, a template content suitable for the motif of music can be selected with ease.

Also, since a musical composition file mF alone can be downloaded as in the conventional art, and fees are charged individually for downloading of a musical composition file mF and downloading of a template file tpF, a service for distributing a music file with animation amF can easily be used in combination with the existing service for distributing a musical composition file mF.

Further, the early and later section parts a and b of a template file tpF are not adjusted. Even if the template file tpF includes display parts of which time lengths should not be extended or reduced such as prologue display and finale display corresponding to the introduction and ending of a musical composition file mF, therefore, such display parts are not affected. It should be noted that if the processing section part SC1 can be extended or reduced to zero to an infinite value, the entire template file tpF can be extended or reduced.

It should be noted that the tables used to make a template list in the steps S102 and S103 in FIG. 4 are not limited to those illustrated in FIGS. 6A and 6B. For example, in the musical tone characteristic-and-template table in FIG. 6B, template files tpF may be associated with combinations of various musical tone characteristic parameters such as tone colors, volumes, frequently occurring pitches and chords, and musical composition genres in the header 51 in place of associating them with keys (major/minor) and tempos of musical compositions. Also, in the case where a musical composition file mF is comprised of waveform data such as a song with vocal, template files tpF may be associated with parameters obtained by, for example, FFT (Fast Fourier Transform) analysis.

Alternatively, a table may be used in which one or more template files tpF are associated in advance with each musical composition file mF. It should be noted that the tables and maps are not limited to two-dimensional ones, but may be three-dimensional ones.

Although in the present embodiment, the reproduction time length of the entire template file tpF is made to completely match the performance time MT of a musical composition file mF, but they should not always completely match each other.

Although in the present embodiment, the data format of a musical composition file mF and a template file tpF is SMAF, this is not limitative. For example, FLASH (Macromedia Flash) (registered trademark) may be used. The content of a musical composition file mF is not limited to an incoming call melody, but may be a "mobile phone song (registered trademark)" or the like.

It should be noted that the content of a template file tpF is not limited to an animation or a moving video picture, but may be, for example, data related to sound effects (e.g., sound image localization control such as three-dimensional sound image production) and vibrator control.

Although in the present embodiment, a music file with animation amF is created by synthesis of a musical composition file mF and a template file tpF, but should not necessarily be integrated data. For example, a set of a musical composition file mF and a template file tpF may be distributed, to which information that associate these files with each other and information for synchronous reproduction of them are added.

Although in the present embodiment, the terminal devices 30 are implemented by cellular mobile phones, but may be any other devices insofar as they have a communicating function, a musical tone reproducing function, and an image displaying function to receive the distributing service provided by the distributing server 10.

It is to be understood that the object of the present invention may also be accomplished by supplying the distributing server 10 with a storage medium in which a program code of software, which realizes the functions of the above described embodiment is stored, and causing a computer (or CPU or MPU) of the system or apparatus to read out and execute the program code stored in the storage medium. In this case, the program code itself read from the storage medium realizes the functions of the above described embodiment, and hence the program code and a storage medium on which the program code is stored constitute the present invention.

Examples of the storage medium for supplying the program code include a floppy (registered trademark) disk, a hard disk, a magnetic-optical disk, an optical disk such as a CD-ROM, a CD-R, a CD-RW, a DVD-ROM, a DVD-RAM, a DVD-RW, and a DVD+RW, a magnetic tape, a nonvolatile memory card, and a ROM. Alternatively, the program code may be downloaded via a network.

Further, it is to be understood that the functions of the above described embodiment may be accomplished not only by executing a program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the storage medium into a memory provided in an expansion board inserted into a computer or a memory provided in an expansion unit connected to the computer and then causing a CPU or the like provided in the expansion board or the expansion unit to perform a part or all of the actual operations based on instructions of the program code.

What is claimed is:

1. A content distributing server comprising:

a musical composition storage device that stores a plurality of musical composition contents each prescribing a musical tone event sequence comprising musical tone event information;

a template storage device that stores a plurality of template contents each prescribing a display control event sequence comprising display control event information;

a communicating device that communicates with at least one terminal device;

a musical composition identifying device that is responsive to a request from the terminal device via said communicating device, for identifying one musical composition content from the plurality of musical composition contents stored in said musical composition storage device;

a template identifying device that is responsive to a request from the terminal device via said communicating device, for identifying one template content from the plurality of template contents stored in said template storage device;

a time length adjusting device that adjusts a reproduction time length of the template content identified by said template identifying device according to a reproduction time length of the musical composition content identified by said musical composition identifying device;

a synthesized content generating device that generates a synthesized content by adding the template content whose reproduction time length has been adjusted by said time length adjusting device to the musical composition content identified by said musical composition identifying device; and a content distributing device that distributes the synthesized content generated by said synthesized content generating device to the terminal device via said communicating device.

2. A content distributing server according to claim 1, comprising a list providing device that is responsive to a template content adding request from the terminal device via said communicating device, for creating a template list including at least one template content candidate that can be added to the identified musical composition content and transmitting the created template list to the terminal device.

3. A content distributing server according to claim 2, wherein:

the musical composition content includes a lyric track, and said list providing device extracts at least one kind of word from the lyric track of the musical composition content identified by said musical composition identifying device and selects the at least one template content candidate based on the extracted word to create the template list.

4. A content distributing server according to claim 2, wherein said list providing device analyzes musical tone characteristics of the musical composition content identified by said musical composition identifying device, and selects the at least one template content candidate based on an analysis result to create the template list.

5. A content distributing server according to claim 1, wherein:

each of the plurality of template contents includes a reproduction section including a first reproduction section in which a reproducing speed is required to be maintained at a constant speed, and a second reproduction section in which a reproducing speed is not required to be maintained at a constant speed, and said time length adjusting device changes only a reproduction time length of the second reproduction section of the template content identified by said template identifying device, to thereby adjust an entire reproduction time length of the identified template content.

6. A content distributing server according to claim 5, wherein:

the reproduction section of each of the plurality of template contents is divided into an early section part, an intermediate section part, and a later section part in terms of time, the early and later section parts being the first reproduction section and the intermediate section part being the second reproduction section, and said time length adjusting device changes only a reproduction time length of the intermediate section of the template content identified by said template identifying device, to thereby adjust the entire reproduction time length of the identified template content.

7. A content distributing server according to claim 6, wherein the reproduction time length of the intermediate section is changed by changing a reproduction time length of at least one display control event information at least partly included in the intermediate section of the template content identified by said template identifying device among display control event information constituting the display control event sequence prescribed by the identified template content so that a display ending time of the display control event information matches an ending time of the intermediate section.

8. A content distributing server according to claim 6, wherein the reproduction time length of the intermediate section is changed by changing a display starting time and a lifetime of at least one display control event information at least partly included in the intermediate section of the template content identified by said template identifying device among display control event information constituting the display control event sequence prescribed by the identified template content.

9. A content distributing server according to claim 6, wherein the reproduction time length of the intermediate section is changed by changing a display starting time, a lifetime, and time parameters of at least one display control event information at least partly included in the intermediate section of the template content identified by said template identifying device among display control event information constituting the display control event sequence prescribed by the identified template content.

10. A content distributing server according to claim 6, wherein the reproduction time length of the intermediate section is changed by repeatedly displaying at least one display control event information at least partly included in the intermediate section of the template content identified by said template identifying device among display control event information constituting the display control event sequence prescribed by the identified template content.

11. A distributing server according to claim 1, comprising:

a musical composition distributing device that distributes the musical composition content alone identified by said musical composition identifying device to the terminal device;

a distribution result managing device that manages results of distribution by said musical composition distributing device and results of distribution by said content distributing device with respect to each of the at least one terminal device; and a charging device that charges based on the results of distribution managed by said distribution result managing device, wherein said charging device is responsive to distribution of a musical composition content alone by said musical composition distributing device, to charge for the distribution of the musical composition content.

12. A content distributing server according to claim 11, wherein in a case where said content distributing device distributes the synthesized content, when the musical composition content identified by said musical composition identifying device is not a musical composition content distributed in the past, fees are charged for both distribution of the identified musical composition content and distribution of the template content added to the identified musical composition content, and when the musical composition content identified by said musical composition identifying device is a musical composition content distributed in the past, a fee is charged for only distribution of the added template content.

13. A content distributing method for a content distributing server comprising a musical composition storage device that stores a plurality of musical composition contents each prescribing a musical tone event sequence comprising musical tone event information, a template storage device that stores a plurality of template contents each prescribing a display control event sequence comprising display control event information, and a communicating device that communicates with at least one terminal device, the content distributing method comprising:

a musical composition identifying step of, in response to a request from the terminal device via the communicating device, identifying one musical composition content from the plurality of musical composition contents stored in the musical composition storage device;

a template identifying step of, in response to a request from the terminal device via the communicating device, identifying one template content from the plurality of template contents stored in the template storage device;

a time length adjusting step of adjusting a reproduction time length of the template content identified in said template identifying step according to a reproduction time length of the musical composition content identified in said musical composition identifying step;

a synthesized content generating step of generating a synthesized content by adding the template content whose reproduction time length has been adjusted in said time length adjusting step to the musical composition content identified in said musical composition identifying step; and a content distributing step of distributing the synthesized content generated in said synthesized content generating step to the terminal device via the communicating device.

14. A content distributing method according to claim 13, comprising a list providing step, in response to a template content adding request from the terminal device via the communicating device, creating a template list including at least one template content candidate that can be added to the identified musical composition content and transmitting the created template list to the terminal device.

15. A content distributing method according to claim 13, wherein:

each of the plurality of template contents includes a reproduction section including a first reproduction section in which a reproducing speed is required to be maintained at a constant speed, and a second reproduction section in which a reproducing speed is not required to be maintained at a constant speed, and in said time length adjusting step, only a reproduction time length of the second reproduction section of the template content identified in said template identifying step is changed, to thereby adjust an entire reproduction time length of the identified template content.

16. A content distributing method according to claim 13, comprising:

a musical composition distributing step of distributing the musical composition content alone identified in said musical composition identifying step to the terminal device;

a distribution result managing step of managing results of distribution by said musical composition distributing device and results of distribution in said content distributing step with respect to each of the at least one terminal device; and a charging step of charging based on the results of distribution managed in said distribution result managing step, wherein in said charging step, in response to distribution of a musical composition content alone in said musical composition distributing step, a fee is charged for the distribution of the musical composition content.

17. A content distributing method according to claim 16, wherein in a case where the synthesized content is distributed in said content distributing step, when the musical composition content identified in said musical composition identifying step is not a musical composition content distributed in the past, fees are charged for both distribution of the identified musical composition content and distribution of the template content added to the identified musical composition content, and when the musical composition content identified in said musical composition identifying step is a musical composition content distributed in the past, a fee is charged for only distribution of the added template content.

18. A content distributing program executed by for causing a computer in a content distributing server comprising a musical composition storage device that stores a plurality of musical composition contents each prescribing a musical tone event sequence comprising musical tone event information, a template storage device that stores a plurality of template contents each prescribing a display control event sequence comprising display control event information, and a communicating device that communicates with at least one terminal device, the content distributing program comprising:

a musical composition identifying module for, in response to a request from the terminal device via the communicating device, identifying one musical composition content from the plurality of musical composition contents stored in the musical composition storage device;

a template identifying module for, in response to a request from the terminal device via the communicating device, identifying one template content from the plurality of template contents stored in the template storage device;

a time length adjusting module for adjusting a reproduction time length of the template content identified in said template identifying step according to a reproduction time length of the musical composition content identified by said musical composition identifying module;

a synthesized content generating module for generating a synthesized content by adding the template content whose reproduction time length time has been adjusted by said time length adjusting module to the musical composition content identified by said musical composition identifying module; and a content distributing module for distributing the synthesized content generated by said synthesized content generating module to the terminal device via the communicating device.

* * * * *